US011589671B2

(12) United States Patent
Pagobo

(10) Patent No.: US 11,589,671 B2
(45) Date of Patent: Feb. 28, 2023

(54) TOOTHBRUSH WITH INTEGRAL TOOTHPASTE DISPENSER

(71) Applicant: John Paul Pagobo, Kelowna (CA)

(72) Inventor: John Paul Pagobo, Kelowna (CA)

(73) Assignee: 1350746 B.C. Ltd., Kelowna (CA)

( * ) Notice: Subject to any disclaimer, the term of this patent is extended or adjusted under 35 U.S.C. 154(b) by 0 days.

(21) Appl. No.: 17/127,996

(22) Filed: Dec. 18, 2020

(65) Prior Publication Data

US 2021/0186194 A1 Jun. 24, 2021

Related U.S. Application Data

(60) Provisional application No. 62/950,849, filed on Dec. 19, 2019.

(51) Int. Cl.
*A46B 11/00* (2006.01)
*A46B 9/04* (2006.01)

(52) U.S. Cl.
CPC ..... *A46B 11/0027* (2013.01); *A46B 9/04* (2013.01); *A46B 11/0065* (2013.01); *A46B 11/0079* (2013.01); *A46B 11/0041* (2013.01); *A46B 2200/1066* (2013.01)

(58) Field of Classification Search
CPC ..... A46B 11/00; A46B 11/001; A46B 11/002; A46B 11/0024; A46B 11/0027; A46B 11/0041; A46B 11/0055; A46B 11/0044; A46B 11/0048; A46B 9/04; A46B 2200/1066
USPC ..... 401/152, 156, 158, 163, 270, 277, 282; 215/216, 220, 221
See application file for complete search history.

(56) References Cited

U.S. PATENT DOCUMENTS 1,780,066 A * 10/1930 Christian ..... A46B 11/0027 401/153
3,261,367 A * 7/1966 Pickering ..... A46B 11/0027 401/135
4,128,349 A 12/1978 Del Bon
4,277,194 A 7/1981 Smith
(Continued)

FOREIGN PATENT DOCUMENTS

CA 2325277 6/2001
CN 2227443 5/1996
(Continued)

*Primary Examiner* — David J Walczak
(74) *Attorney, Agent, or Firm* — Richard D. Okimaw

(57) ABSTRACT

An apparatus for dispensing a material from a cartridge comprises a dispensing head having a passage therethrough, the passage extending from a receiving socket to a dispensing orifice through said dispensing head, an outer casing, securable to the dispensing head and rotatably relative to the dispensing head and an end cap threadably received within the dispensing head and having an end connector disposed towards the dispensing head. The receiving socket and the end connector are adapted to receive the cartridge so as to rotatably fix the end cap relative to the dispensing head wherein rotation of the outer casing threadably moves the end cap in a longitudinal direction thereby compressing the cartridge between the dispensing head and the end cap. A kit may include the apparatus and a cartridge extending between first and second ends and having an interior adapted to contain a substance to be dispensed therefrom.

20 Claims, 5 Drawing Sheets

(56) References Cited

U.S. PATENT DOCUMENTS

| | | | | |
|---|---|---|---|---|
| 4,388,011 | A | 6/1983 | Smith | |
| 4,615,635 | A | 10/1986 | Kim | |
| 5,186,563 | A * | 2/1993 | Gebhard | A46B 11/0027 222/214 |
| 5,244,298 | A | 9/1993 | Greenhouse | |
| 5,462,377 | A | 10/1995 | Martinez, Jr. et al. | |
| 6,176,381 | B1 * | 1/2001 | Mader | B65D 50/067 215/217 |
| 6,238,118 | B1 | 5/2001 | Tryon | |
| 7,699,552 | B2 | 4/2010 | Grez et al. | |
| 7,806,689 | B2 | 10/2010 | Lee et al. | |
| 8,506,192 | B2 | 8/2013 | Allbritton | |
| 9,339,103 | B1 | 5/2016 | Watters | |
| 2011/0286784 | A1 | 11/2011 | Gipson | |
| 2012/0090116 | A1 | 4/2012 | Hebebrand | |

FOREIGN PATENT DOCUMENTS

| | | |
|---|---|---|
| DE | 3423400 | 3/1987 |
| FR | 2680656 | 8/1991 |
| WO | 2009155746 | 12/2009 |

* cited by examiner

TOOTHBRUSH WITH INTEGRAL TOOTHPASTE DISPENSER

CROSS REFERENCE TO RELATED APPLICATION

This application claims priority to U.S. Provisional Application No. 62/950,849 filed Dec. 19, 2019 entitled TOOTHBRUSH WITH INTEGRATED TOOTHPASTE DISPENSER.

BACKGROUND

1. Technical Field

This disclosure relates generally to toothbrushes and in particular to a toothbrush with an integrated toothpaste dispenser.

2. Description of Related Art

Toothbrushes and toothpaste are common items for most individuals. However when traveling or away from home, some people may remember to bring their toothbrush but forget toothpaste. There exists therefor a need to provide an integrated toothpaste dispenser with a toothbrush for convenience of a user and assisting in preventing such occurrences.

Previous attempts to provide a toothpaste dispensing toothbrush have not been satisfactory. In particular, previous attempts have been made to provide a cartridge contained within a handle body which has a slidable or otherwise movable member adapted to compress an end of the cartridge with a slide so as to dispel a quantity of toothpaste therefrom. Disadvantageously, such designs provide a small surface area to grip by a user relative to the force required and therefore may be difficult to operate as the toothpaste dries. Examples of such designs may be found, for example in US Patent Application Publication No. 2008/0003048 to Glassman et al.

SUMMARY OF THE DISCLOSURE

According to a first embodiment, there is disclosed an apparatus for dispensing a material from a cartridge comprising a dispensing head having a passage therethrough, the passage extending from a receiving socket to a dispensing orifice through said dispensing head, an outer casing, securable to the dispensing head and rotatably relative to the dispensing head and an end cap threadably received within the outer casing and having an end connector disposed towards the dispensing head. The receiving socket and the end connector are adapted to receive the cartridge so as to rotatably fix the end cap relative to the dispensing head wherein rotation of the outer casing threadably moves the end cap in a longitudinal direction thereby compressing the cartridge between the dispensing head and the end cap.

The receiving socket may have a square cross section. The dispensing head may have bristles proximate to the dispensing orifice. The dispensing head may further comprise a tooth brush head. The apparatus may further comprise a lock operable to fix the rotation of the outer casing relative to the dispensing head.

The apparatus may further comprise a bearing ring rotatably connected to the outer casing. The bearing ring may be rotatable relative to the outer casing with a bushing or bearing. The bearing ring may include a connector for connection to the dispensing head. The bearing ring may include threading adapted to threadably receive the dispensing head therein.

The outer casing includes drive threading engagable with threading surrounding the end cap. The drive threading extends through the length of the outer casing.

According to a further embodiment, there is disclosed a kit for dispensing a material comprising a cartridge extending between first and second ends and having an interior adapted to contain a substance to be dispensed therefrom and an apparatus for dispensing the substance in the cartridge. The apparatus comprises dispensing head having a passage therethrough, the passage extending from a receiving socket to a dispensing orifice through said dispensing head, an outer casing, securable to the dispensing head and rotatably relative to the dispensing head and an end cap threadably received within the dispensing head and having an end connector disposed towards the dispensing head. The receiving socket and the end connector are adapted to receive the cartridge so as to rotatably fix the end cap relative to the dispensing head wherein rotation of the outer casing threadably moves the end cap in a longitudinal direction thereby compressing the cartridge between the dispensing head and the end cap.

The cartridge may have a longitudinally compressible outer body. The outer body may have an accordion profile. The first end may include a profile adapted to be non-rotatably received within the receiving socket of the dispensing head.

The second end may include a cartridge connector adapted to non-rotatably connect to the end connector of the end cap. The cartridge connector may comprise a cartridge socket. The end connector may comprise a cartridge protrusion. The cartridge socket and cartridge protrusion may have cooperating profiles.

According to a further embodiment, there is disclosed a method for dispensing a toothpaste comprising locating a cartridge within sockets between a dispending head and an end cap and rotating an outer casing relative to the dispending head so as to threadably displace the end cap towards the dispensing head thereby compressing the cartridge therebetween wherein the end cap is rotatably fixed relative to the dispensing head by the cartridge.

Other aspects and features of the present disclosure will become apparent to those ordinarily skilled in the art upon review of the following description of specific embodiments in conjunction with the accompanying figures.

BRIEF DESCRIPTION OF THE DRAWINGS

In drawings which illustrate embodiments of the present disclosure wherein similar characters of reference denote corresponding parts in each view.

DETAILED DESCRIPTION

Figure 1:
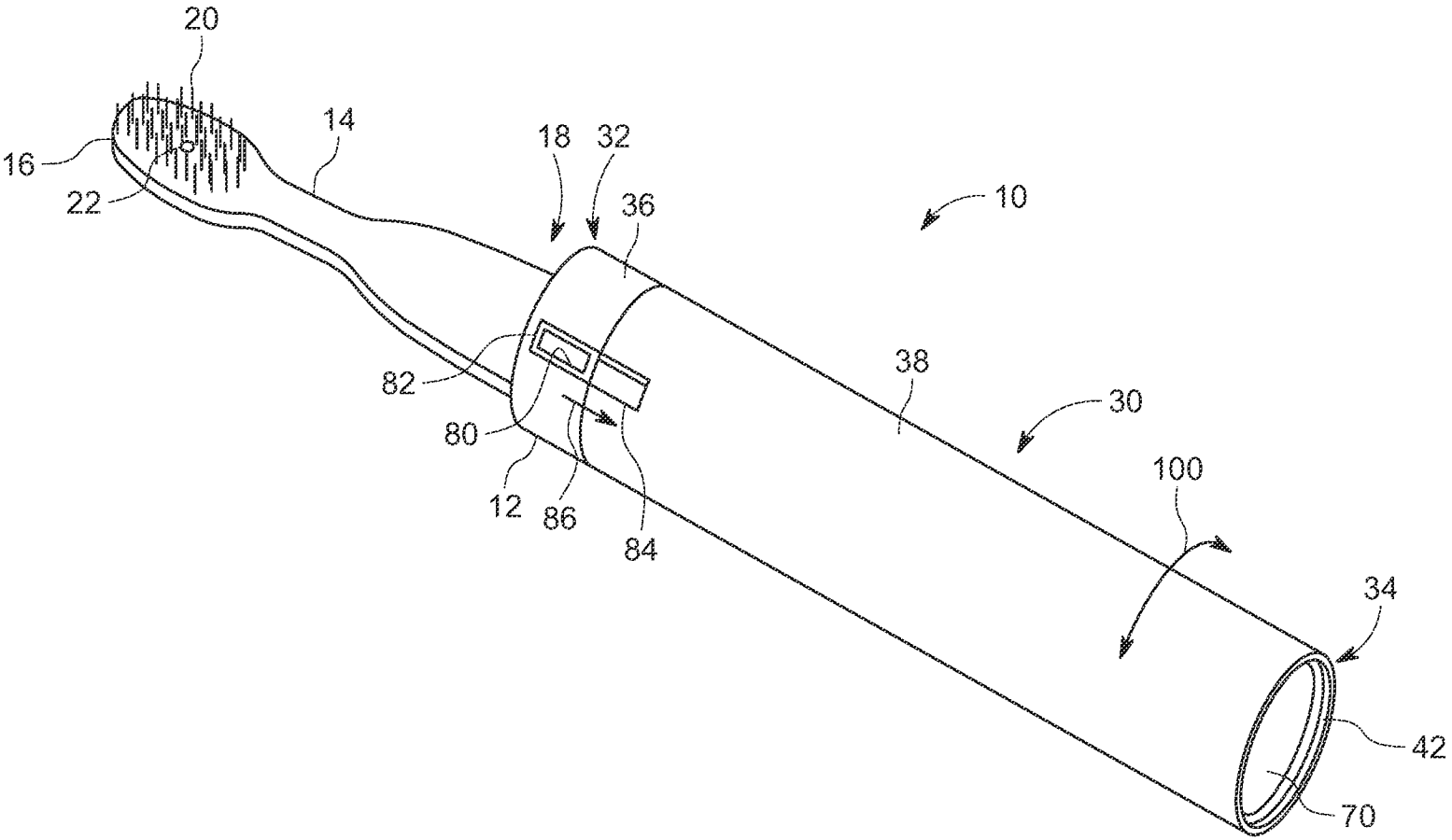
FIG. 1 is a perspective view of an apparatus for dispensing toothpaste according to a first embodiment of the present disclosure.

Referring to FIG. 1, an apparatus for dispensing a material according to a first embodiment of the disclosure is shown generally at 10. In particular, the apparatus may be incorporated into a toothbrush 12 with integral toothpaste dispenser according to a first embodiment. The toothbrush 12 as illustrated in FIG. 1 includes a dispensing head 14 with a rotatable handle 30 having a longitudinally compressible cartridge 50 therein. As will be more fully set out below, the handle 30 is rotated relative to the dispensing head 14 so as to move an end cap 70 within the handle towards the dispensing head 14 thereby compressing the cartridge and dispensing the toothpaste therefrom.

Figure 2:
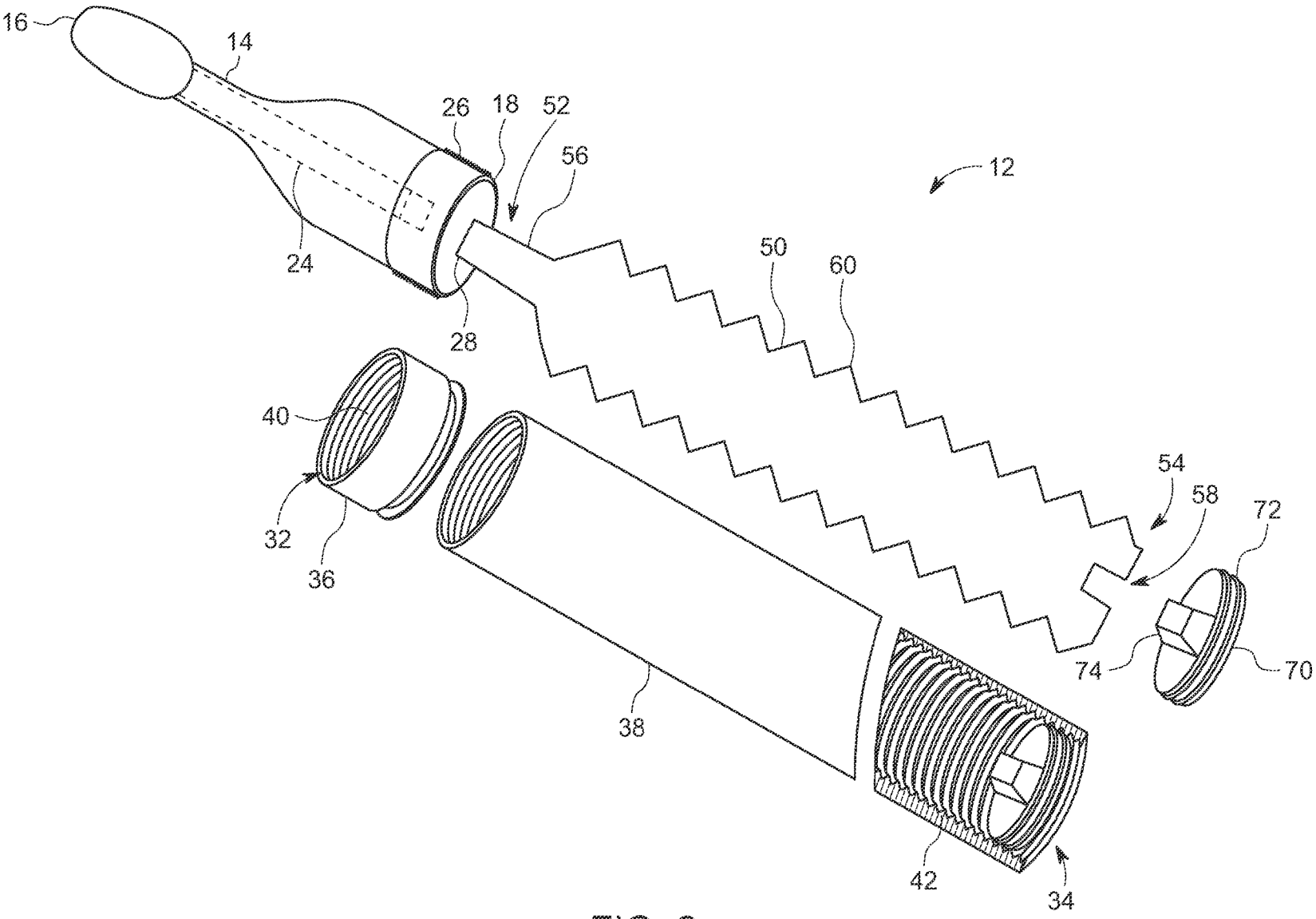
FIG. 2 is an exploded view of the apparatus of FIG. 1.
Figure 3:
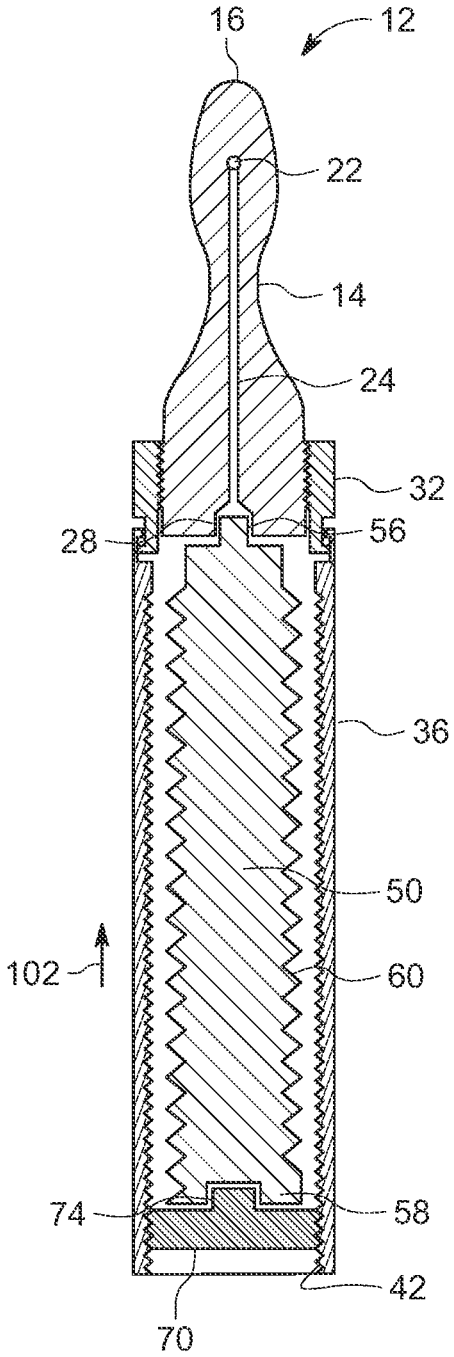
FIG. 3 is a cross sectional view of the apparatus of FIG. 1 at a first tor initial position.
Figure 4:
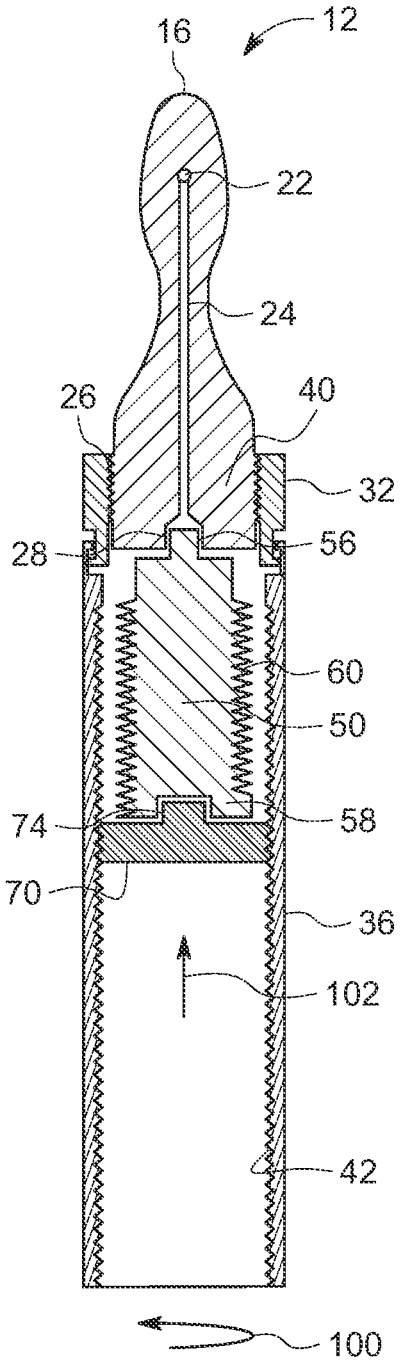
FIG. 4 is a cross sectional view of the apparatus of FIG. 1 at a second or dispensing position.

Turning now to FIGS. 2 through 4, the dispensing head 14 extends between a bristle end 16 and a handle end 18. The bristle end 16 includes toothbrush bristles 20 as are well known and an orifice 22 extending into an interior passage 24 thereof. The handle end 18 may include exterior threading 26 therearound adapted to engage with and be threadably received within the handle 30. The passage may include a check or flap valve therein so as to permit flow of the toothpaste in a direction out of the orifice 22 only. As illustrated in FIGS. 2 through 4, the dispensing head includes a socket 28 adapted to non-rotatably receive an end of the cartridge therein. It will be appreciated that this socket 28 prevents relative rotation between the dispensing head 14 and the cartridge 50. Although the socket is illustrated as being square, it will be appreciated that any corresponding shape between the socket and cartridge may be selected.

The handle 30 comprises an elongate tubular body extending between first and second ends, 32 and 34, respectively. The handle 30 is formed of a fixed portion 36 or bearing ring proximate to the first end 32 and a rotatable portion 38 rotatably supported by the fixed portion 36 in a direction generally indicated at 100. As illustrated in FIGS. 2 through 4, the fixed portion 36 includes internal threading 40 adapted to engage on the exterior threading 26 of the dispensing head 14 so as to securely fasten the fixed portion 36 thereto. The fixed portion 36 may also be secured to the dispensing head 14 in any other suitable connector. The rotatable portion 38 includes a bearing or the like at an end proximate to the fixed portion 36 so as to permit relative rotation therebetween. It will be appreciated that this bearing or bushing may also seal the connection between the rotatable and fixed portions 38 and 36. The interior of the rotatable portion 38 includes threading 42 adapted to engage an interior end cap 70 as will be further described below.

The end cap 70 comprises a substantially disk shaped body having exterior threading 72 therearound corresponding to the interior threading 42 in the rotatable portion 36. The end cap 70 further includes a protrusion 74 extending therefrom adapted to be received within a corresponding socket 58 of the cartridge 50 as will be more fully set out below. It will also be appreciated that any other non-rotatable connections may be utilized between the end cap and the cartridge such as by way of non-limiting example including a protrusion on the cartridge and a socket on the end cap.

The cartridge 50 extends between first and second ends, 52 and 54, respectively, and includes a protrusion 56 extending from the first end 52 and has a socket 58 into the second end 54. The protrusion 56 is sized and shaped to correspond to the socket 28 in the dispensing head. In particular, the protrusion 56 is received therein in such a manner as to be non-rotatable relative thereto. It will be appreciated that any shape may be selected for this purpose so as to provide such restriction on rotation. Furthermore, the socket 58 in the second end is sized and shaped to correspond to a protrusion 74 in the end cap 70. In particular, the socket 58 is received therein in such a manner as to be non-rotatable relative thereto. It will be appreciated that any shape may be selected for this purpose so as to provide such restriction on rotation.

The cartridge 50 is shaped to be longitudinally compressible between the first and second ends while resisting twisting. In such a manner, the rotation of the rotatable portion 38 of the handle 30 turns the threading 42 relative to the end cap 70 which is prevented from turning by the cartridge. Such rotation therefore moves the end cap 70 relative to the rotatable portion in a direction generally indicated at 102. As illustrated, the cartridge may have an accordion shaped outer body adapted to permit ease of longitudinal compression while reducing twisting therein. It will be appreciated that the cartridge 50 is substantially hollow so as to contain a quantity of the toothpaste and may include an opening through the protrusion 56. Therefor as the cartridge is compressed between the dispensing head 14 and the end cap 70, the toothpaste will be discharged through the passage 24 and out of the orifice 22.

Figure 5:
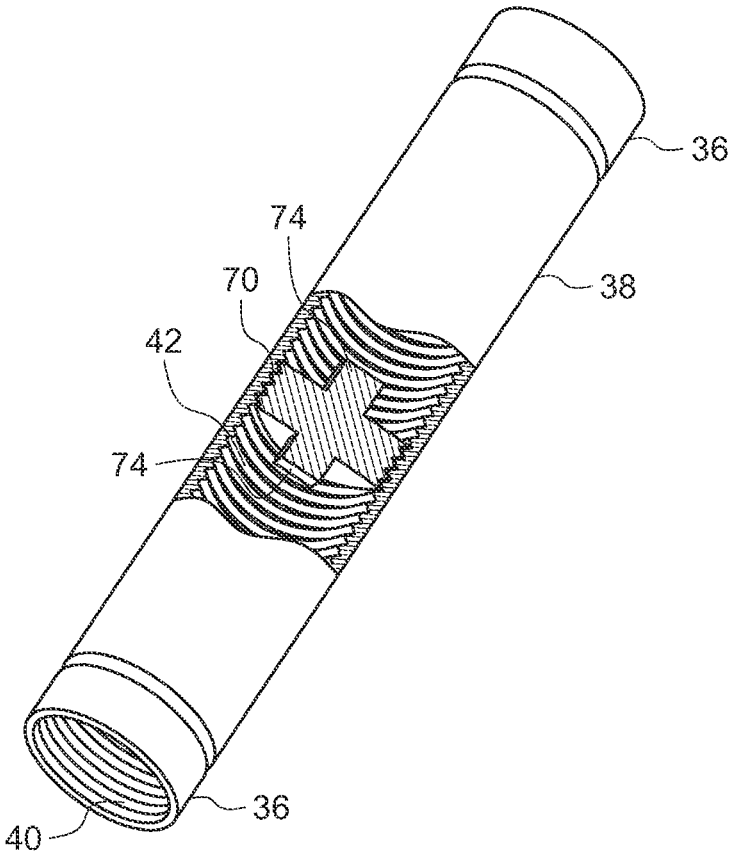
FIG. 5 is a cross sectional view of a handle for use in the apparatus of FIG. 1 according to a further embodiment.

Turning now to FIG. 5, an alternative handle 30 is illustrated having a pair of fixed portions 36 at each end of the rotatable portion 38. Each of the fixed portions 36 may be secured to the dispensing head 14 so as to permit the orientation of the handle 30 to be reversed. As illustrated in FIG. 5, the end cap 70 also includes a protrusion 74 extending from each side thereof. In operation, the handle to compress a cartridge 50 towards the dispensing head 14 and thereafter removed from the dispensing head 14 when the cartridge is empty. The handle may then be reversed such that the end cap 70 is again distal from the dispensing head 14 to compress a subsequent cartridge without having to manually move the end cap 70 back to the initial or extended position shown in FIG. 3.

Optionally the fixed portion 36 or dispensing head may include a slide lock 80 contained within a longitudinal slot 82. The slide lock 80 may be slid in a direction generally indicated at 86 to be received within a corresponding slot 84 in the rotatable portion 38 so as to span the slots 82 and 84 thereby preventing relative rotation between the rotatable portion and fixed portions when the toothbrush is in use. Other suitable rotation locks may be utilized as well.

While specific embodiments have been described and illustrated, such embodiments should be considered illustrative only and not as limiting the disclosure as construed in accordance with the accompanying claims.

What is claimed is:

1. An apparatus for dispensing a material from a cartridge comprising:

a dispensing head having a passage therethrough, the passage extending from a receiving socket to a dispensing orifice through said dispensing head, wherein the receiving socket is configured to immovably receive a cooperating cartridge therein;

an outer casing, securable to the dispensing head and rotatably relative to the dispensing head; and an end cap threadably received within the outer casing and having an end connector disposed towards the dispensing head, wherein the end connector is configured to immovably engage with a cooperating cartridge, wherein the receiving socket receives the cartridge in a non-rotating fixed connection therebetween and the end connector engages the cartridge in a non-rotating fixed connection therebetween so as to rotatably fix the end cap and cartridge relative to the dispensing head wherein rotation of the outer casing threadably moves the end cap in a longitudinal direction thereby compressing the cartridge between the dispensing head and the end cap, wherein the apparatus does not include any intervening structures between the outer casing and an installed cartridge.

2. The apparatus of claim 1 wherein the receiving socket has a square cross section.

3. The apparatus of claim 1 wherein the dispensing head has bristles proximate to the dispensing orifice.

4. The apparatus of claim 3 wherein the dispensing head comprises a tooth brush head.

5. The apparatus of claim 1 further comprising a lock operable to fix the rotation of the outer casing relative to the dispensing head.

6. The apparatus of claim 1 further comprising a bearing ring rotatably connected to the outer casing.

7. The apparatus of claim 6 wherein the bearing ring is rotatable relative to the outer casing with a bushing or bearing.

8. The apparatus of claim 6 wherein the bearing ring includes a connector for connection to the dispensing head.

9. The apparatus of claim 8 wherein the bearing ring includes threading adapted to threadably receive the dispensing head therein.

10. The apparatus of claim 1 wherein the outer casing includes drive threading engagable with threading surrounding the end cap.

11. The apparatus of claim 10 wherein the drive threading extends through the length of the outer casing.

12. A kit for dispensing a material comprising:

a cartridge extending between first and second ends and having an interior adapted to contain a substance to be dispensed therefrom; and an apparatus of claim 1.

13. The kit of claim 12 wherein the cartridge has a longitudinally compressible outer body.

14. The kit of claim 13 wherein the outer body has an accordion profile.

15. The kit of claim 12 wherein the first end includes a profile adapted to be non-rotatably received within the receiving socket of the dispensing head.

16. The kit of claim 12 wherein the second end includes a cartridge connector adapted to non-rotatably connect to the end connector of the end cap.

17. The kit of claim 16 wherein the cartridge connector comprises a cartridge socket.

18. The kit of claim 17 wherein the end connector comprises a cartridge protrusion.

19. The kit of claim 18 wherein the cartridge socket and cartridge protrusion have cooperating profiles.

20. A method for dispensing a toothpaste comprising:

locating a cartridge, having a first end configured to be immovably received within a receiving socket of a dispending head and a second end configured to be immovably engaged with an end cap in a non-rotating fixed connection therebetween; and rotating an outer casing, with no intervening structures between the outer casing and the cartridge, relative to the dispending head so as to threadably displace the end cap towards the dispensing head thereby compressing the cartridge therebetween wherein the end cap is rotatably fixed relative to the dispensing head by the cartridge.

* * * * *